US007575119B2

(12) United States Patent
Clevenger

(10) Patent No.: US 7,575,119 B2
(45) Date of Patent: Aug. 18, 2009

(54) AUTOMOBILE ACCESSORY PACKAGE

(76) Inventor: Daniel Clevenger, 496 Military Cv, Collierville, TN (US) 38107

( * ) Notice: Subject to any disclaimer, the term of this patent is extended or adjusted under 35 U.S.C. 154(b) by 524 days.

(21) Appl. No.: 11/263,265

(22) Filed: Oct. 31, 2005

(65) Prior Publication Data

US 2007/0095704 A1 May 3, 2007

(51) Int. Cl.
*B65D 85/00* (2006.01)

(52) U.S. Cl. ..... 206/495; 206/459.5; 206/806

(58) Field of Classification Search ..... 206/495, 206/806, 232, 459.5, 461, 776, 472
See application file for complete search history.

(56) References Cited

U.S. PATENT DOCUMENTS 3,814,303 A * 6/1974 Smith ..... 229/117.18
4,106,615 A * 8/1978 Hiroshi ..... 229/117.18
4,140,218 A * 2/1979 Forte ..... 206/303
4,378,903 A * 4/1983 Sherwood ..... 229/117.18
5,184,728 A * 2/1993 Wile ..... 206/554
5,458,235 A * 10/1995 Stone ..... 206/232
5,692,671 A * 12/1997 Mussier et al. ..... 229/117.14
6,375,010 B1 * 4/2002 Thibault ..... 206/762
2002/0088731 A1 * 7/2002 Wenninger ..... 206/459.5
2005/0061759 A1 * 3/2005 Doucette ..... 211/85.4
2005/0087469 A1 * 4/2005 Carty et al. ..... 206/461
2006/0065556 A1 * 3/2006 Schneider ..... 206/232

* cited by examiner

*Primary Examiner*—David T Fidei
(74) *Attorney, Agent, or Firm*—George R. McGuire; Bond Schoeneck & King, PLLC

(57) ABSTRACT

The present invention provides a package for housing an automotive accessory package, comprising a front panel extending in a first plane; a rear panel extending in a second plane which is substantially parallel to the first plane when the package is in an assembled condition; and a display hanger formed in the rear panel and having a periphery a first portion of which is separable from the rear panel and a second portion of which is adapted for pivotal movement relative to the rear panel. The front panel includes a window that permits a consumer to view an automotive accessory stored within the package.

4 Claims, 4 Drawing Sheets

AUTOMOBILE ACCESSORY PACKAGE

BACKGROUND OF THE INVENTION

The present invention relates to packages for automotive accessories, and more particularly to packages that are adapted to be efficiently stowed in a merchandising display.

Automotive accessories, such as drive belts are typically packaged in a paperboard wrapping that envelops a center portion of the accessory the end regions of which are left exposed. With automotive belts, the belt is wound in a serpentine manner prior to being enveloped with the partial wrapping, and with loops being formed at the upper and lower unwrapped regions. The belts are then hung serially on pegs or hooks.

This traditional packaging is complicated in that the belts have to be wound in the serpentine manner prior to being enveloped in the partial wrapping, and the display takes up a large amount of space. In addition, the limited packaging provides little "writing" area on which the product can be described or other information can be conveyed to the purchaser.

It is therefore a principal object and advantage of the present invention to provide a package for an automotive accessory that stores the entire accessory therein.

It is a further object and advantage of the present invention to provide an automotive accessory package that provides a sufficient amount of space on which to convey information to the consumer.

It is an additional object and advantage of the present invention to provide an automotive accessory package that can be stowed in an efficient manner in a point of sale merchandising display.

It is yet an additional object and advantage of the present invention to provide an automotive accessory package that may be displayed on a variety of point of sale merchandising displays.

Other objects and advantages of the present invention will in part be obvious and in part appear hereinafter.

SUMMARY OF INVENTION

In accordance with the foregoing objects and advantages, the present invention provides a package for housing an automotive accessory package, comprising a front panel extending in a first plane; a rear panel extending in a second plane which is substantially parallel to the first plane when the package is in an assembled condition; and a display hanger formed in the rear panel and having a periphery a first portion of which is separable from the rear panel and a second portion of which is adapted for permitting pivotal movement of the hanger relative to the rear panel. The front panel includes a window that permits a consumer to view an automotive accessory stored within the package.

A pair of opposed side panels interconnect the front and rear panels and may include consumer usable information imprinted thereon. Due to the recti-linear shape of the package, a plurality of them may be displayed in side by side relation on a point of sale merchandising rack with on of their side panels being the only portion visible to a consumer without having to remove the package from the display rack. Thus, by imprinting consumer useful information on the side panels, such as the size and style of the accessory stored within the package, a consumer can quickly choose the appropriate accessory from the display rack.

BRIEF DESCRIPTION OF THE DRAWINGS

The present invention will be further understood and more fully appreciated by reading the following Detailed Description in conjunction with the accompanying drawings, in which.

DETAILED DESCRIPTION

Figure 1:
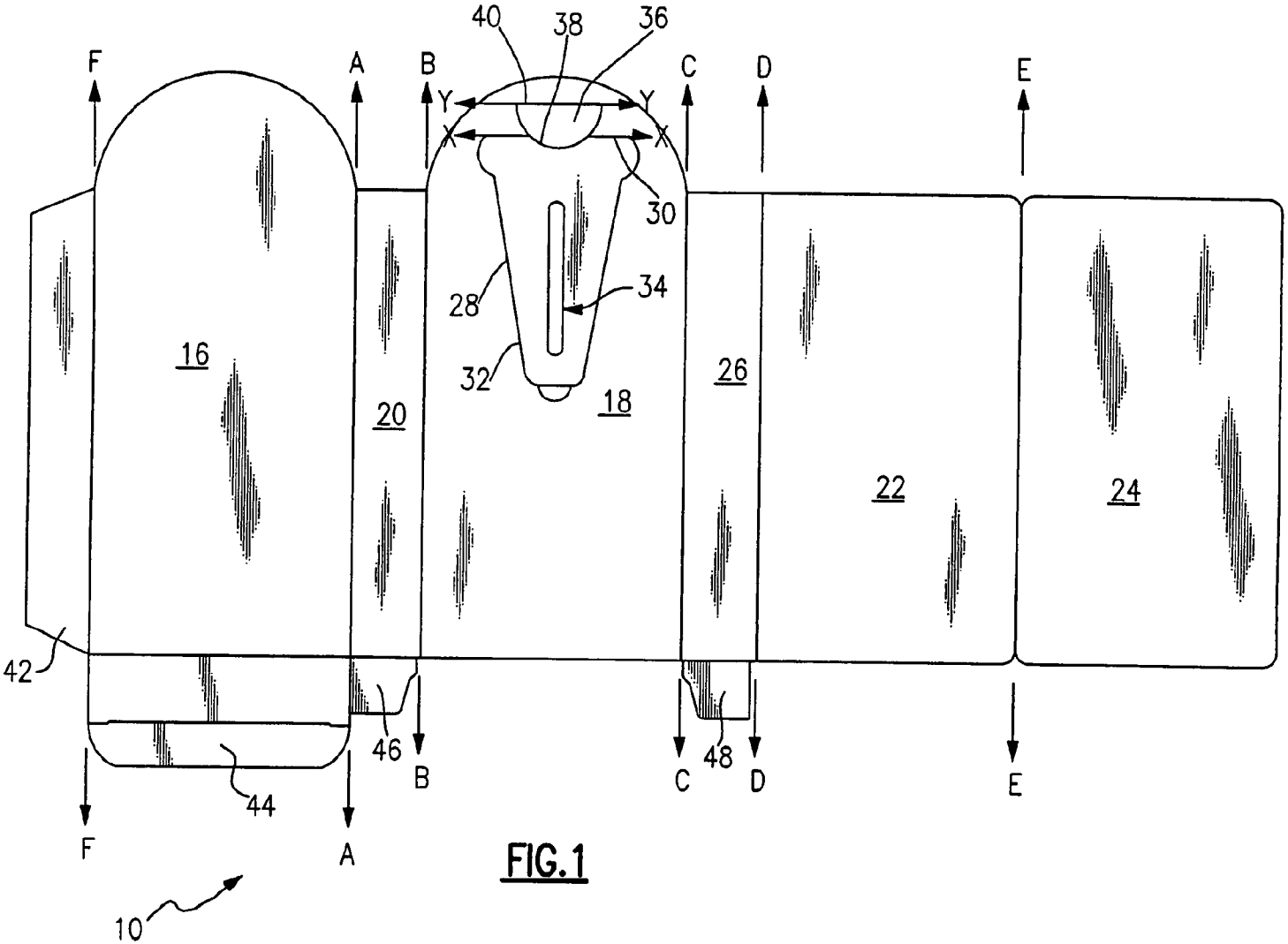
FIG. 1 is a plan view of the blank from which the automotive accessory package of the present invention is formed.
Figure 2:
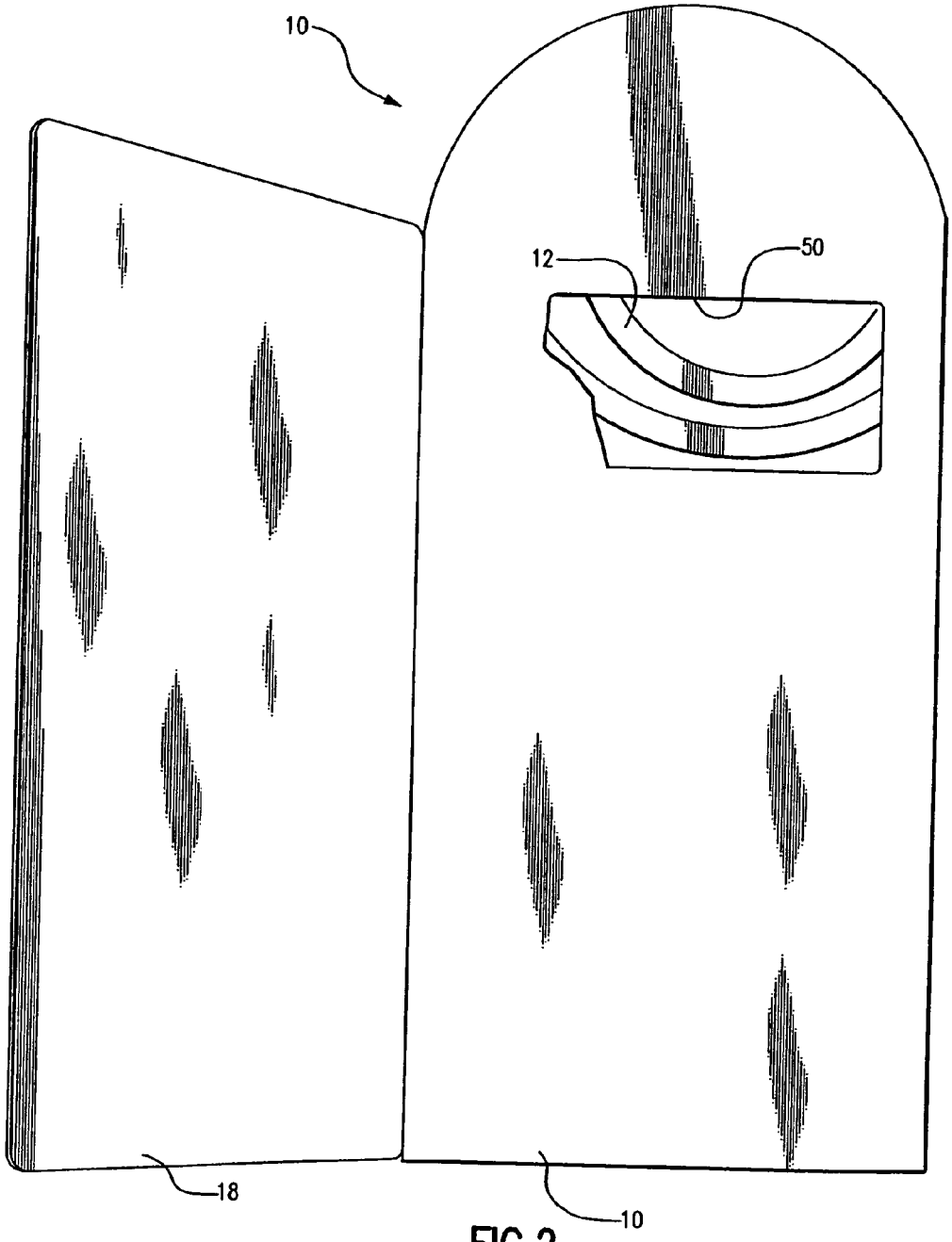
FIG. 2 is a perspective view of an assembled automotive accessory package.
Figure 3:
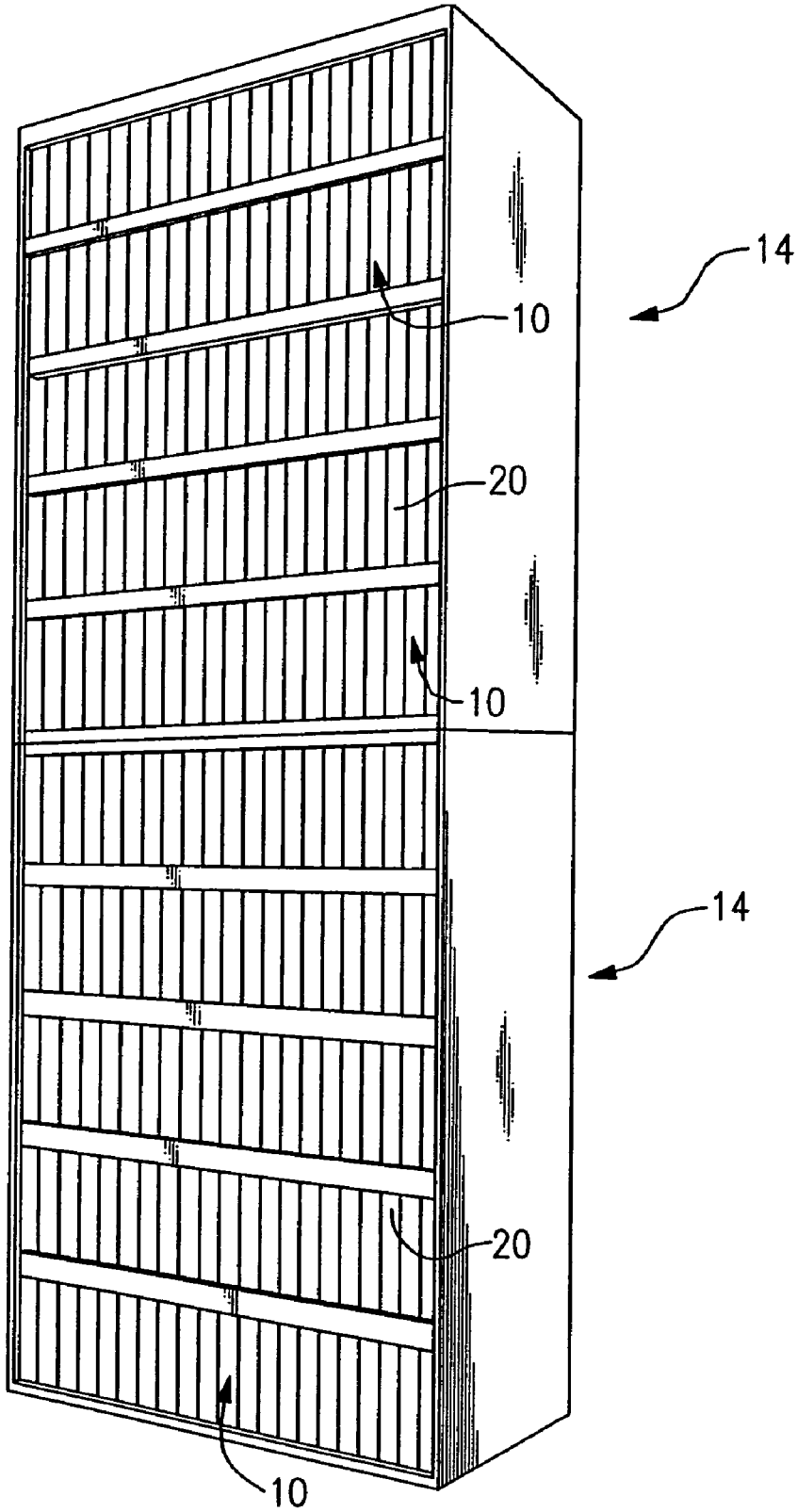
FIG. 3 is a perspective view of a point of sale merchandising display on which a plurality of automotive accessory packages are placed.
Figure 4:
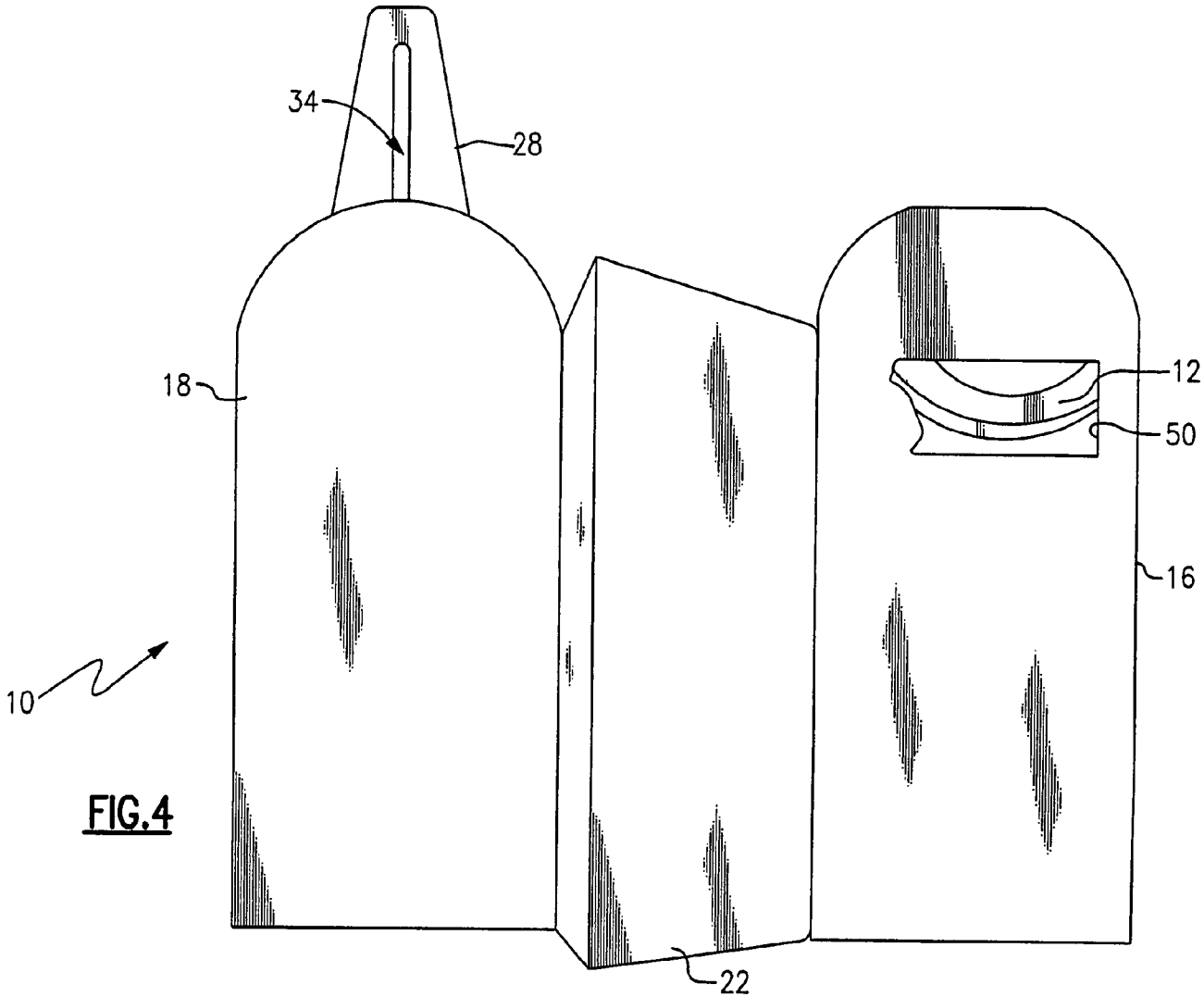
FIG. 4 is a perspective view of the package in an open position and with the hanger shown separated from the rear panel of the package.

Referring now to the drawings in which like reference numerals refer to like parts throughout, there is seen an automotive accessory package, designated generally by reference numeral 10, for storing an automobile accessory 12 therein and being adapted for efficient placement in/on a point of sale merchandising display 14. Accessory 12 is, in the preferred embodiment, an automotive belt, but any type of product (automotive or otherwise) that fits within the confines of the package could be placed therewithin.

Package 10 essentially comprises a front panel 16 that extends in a plane, a rear panel 18 interconnected to front panel 16 by a side panel 20 to which both front and rear panels are hingedly connected, with the rear panel extending in a plane that is spaced from and substantially parallel to that of the front panel when the package is in an assembled (i.e., closed) position. Further features of package 10 include internal panels 22, 24 that are hingedly connected to one another and one of which (panel 22) is hingedly connected to rear panel 16 via a second side panel 26. The axes about which each of the panels 16-26 are hingedly connected to one another, A-A, B-B, C-C, D-D, and E-E, respectively, are each substantially parallel to one another. Internal panels 22, 24 are adapted to have information about the product written thereon and will be viewable by a consumer by opening front panel 16 (i.e., hingedly moving panel 16 about axis A-A). In addition, side panels 20, 26 are each adapted to be imprinted with useful information about the product so that a consumer can view this useful information when the packages are arranged on a point of sale merchandising display 14 that arranges them in side by side relation to one another without having to take the package off of the display unit 14 (e.g., such that the packages serve much the same purpose as a binding of a book when a book is placed on a bookshelf with only the binding being visually exposed to a person).

Rear cover 18 includes a display hanger 28 formed therein. Display hanger 28 includes an essentially downwardly oriented, triangular shaped periphery with the base 30 of the triangle extending along an axis X-X and being scored relative to rear panel 18, while the remainder of the periphery 32 is perforated relative to rear panel 18. Thus, if separation of hanger 28 from rear panel 18 is desired, the perforated periphery 32 is separated and the scored base 30 permits hinged movement of hanger 28 about axis X-X.

A slot 34 is formed through hanger 28 and permits hanger 28 to be placed over a pin or other wall hanging member, thereby permitting package 10 to be displayed on a wall merchandising unit.

In addition, if the entire display hanger 28 is not desired for use, a semi-circular removable cut-out /tab 36 is also formed in rear panel 18. cut-out 36 includes perforated periphery 38 and scored periphery 40 extending along an axis Y-Y and about which the cut-out portion may hingedly move if separated from rear panel 18.

To assemble package 10, front and rear panels 16, 18 are folded about axes A-A and B-B, respectively, until they lie in spaced, parallel planes. Internal panel 22 is hinged about axis D-D between front and rear panels 16, 18, and internal panel 24 is folded about axis E-E between internal panel 22 and rear panel 18. Conventional closure flaps 42, 44, 46, and 48 are all folded and tucked into package 10 in a conventional manner to fully enclose the package. A space is defined between front panel 16 and rear panel 18 in which accessory 12 may be stowed. A window 50 formed in front panel 16 permits a consumer to view accessory 12 therethrough.

What is claimed is:

1. An automotive accessory package, comprising:

a. a front panel extending in a first plane;

b. a rear panel extending in a second plane which is substantially parallel to said first plane when the package is in an assembled condition;

c. a display hanger formed in said rear panel and having a periphery a first portion of which is separable from said rear panel and a second portion of which is adapted to permit pivotal movement of said display hanger relative to said rear panel;

d. a tab formed in said rear panel and adapted to be at least partially separable from said rear panel to form an opening in said rear panel when said tab is at least partially separated from said rear panel;

e. a first side panel interconnecting said front and rear panels;

f. a second side panel attached for hinged movement relative to said rear panel and opposite said first side panel; and g. a first informational panel hingedly connected to said second side panel opposite said rear panel.

2. The automotive accessory package of claim 1, wherein said front panel includes a window formed therein through which a consumer can visually inspect the package's contents.

3. The automotive accessory panel according to claim 1, wherein said first side panel includes consumer useful information imprinted thereon.

4. The automotive accessory package of claim 1, further comprising a second informational panel hingedly connected to said first informational panel opposite said second side panel.

* * * * *